US012392346B2

(12) United States Patent
Lu

(10) Patent No.: US 12,392,346 B2
(45) Date of Patent: Aug. 19, 2025

(54) CAN SYSTEM AND DUAL ELECTRIC SUBMERSIBLE PUMP DEVICE

(71) Applicant: BESTMATCH ENERGY TECHNOLOGY SERVICE COMPANY, Shenzhen (CN)

(72) Inventor: Shengwei Lu, Shenzhen (CN)

(73) Assignee: BESTMATCH ENERGY TECHNOLOGY SERVICE COMPANY, Shenzhen (CN)

( * ) Notice: Subject to any disclaimer, the term of this patent is extended or adjusted under 35 U.S.C. 154(b) by 68 days.

(21) Appl. No.: 18/400,484

(22) Filed: Dec. 29, 2023

(65) Prior Publication Data

US 2024/0133382 A1 Apr. 25, 2024

Related U.S. Application Data

(63) Continuation of application No. PCT/CN2022/118181, filed on Sep. 9, 2022.

(30) Foreign Application Priority Data

Dec. 31, 2021 (CN) ..... 202111675401.3

(51) Int. Cl.
*F04D 13/10* (2006.01)
*E21B 43/12* (2006.01)
(Continued)

(52) U.S. Cl.
CPC ..... *F04D 13/10* (2013.01); *E21B 43/128* (2013.01); *F04B 23/04* (2013.01); *F04B 47/06* (2013.01);
(Continued)

(58) Field of Classification Search
CPC ..... E21B 43/128; F04D 13/10; F04D 13/08; F04D 13/0693; F04D 13/12; F04B 23/04; F04B 47/06
See application file for complete search history.

(56) References Cited

U.S. PATENT DOCUMENTS 5,099,920 A * 3/1992 Warburton ..... E21B 47/047 166/250.03
7,736,133 B2 * 6/2010 Martinez ..... E21B 43/128 417/423.5
(Continued)

FOREIGN PATENT DOCUMENTS

CN 101132126 A 2/2008
CN 101560872 A 10/2009
(Continued)

OTHER PUBLICATIONS

First Office Action issued in counterpart Chinese Patent Application No. 202111675401.3, dated Apr. 24, 2024.
(Continued)

*Primary Examiner* — Charles G Freay
(74) *Attorney, Agent, or Firm* — Westbridge IP LLC

(57) ABSTRACT

Disclosed are a can system and a dual electric submersible pump device, applied to the technical field of dual electric submersible pump devices for oil well development. The dual electric submersible pump device includes an upper pump assembly and a lower pump assembly. The can system includes a can body and a connector assembly. The can body is provided with an accommodating cavity and a connecting hole in communication with the accommodating cavity. The connector assembly is passing through the connecting hole. One end of the connector assembly is located in the accommodating cavity and electrically connected to a first power supply cable, and another end of the connector assembly is disposed outside the accommodating cavity and is electrically connected to a lower pump electrical cable.

13 Claims, 5 Drawing Sheets

(51) Int. Cl.

| | |
|---|---|
| ***F04B 23/04*** | (2006.01) |
| ***F04B 47/06*** | (2006.01) |
| ***F04D 13/06*** | (2006.01) |
| ***F04D 13/08*** | (2006.01) |
| ***F04D 13/12*** | (2006.01) |
| ***F04D 29/40*** | (2006.01) |
| *F04B 53/16* | (2006.01) |

(52) U.S. Cl.
CPC ..... *F04D 13/0693* (2013.01); *F04D 13/08* (2013.01); *F04D 13/12* (2013.01); *F04B 53/16* (2013.01); *F04D 29/406* (2013.01)

(56) References Cited

U.S. PATENT DOCUMENTS

| | | | | |
|---|---|---|---|---|
| 2011/0056699 | A1* | 3/2011 | Bjoroy ..... | F04B 23/04 166/369 |
| 2016/0312590 | A1 | 10/2016 | Chang et al. | |
| 2018/0216447 | A1 | 8/2018 | Al-Zahrani | |
| 2021/0270119 | A1 | 9/2021 | Brown et al. | |

FOREIGN PATENT DOCUMENTS

| | | | |
|---|---|---|---|
| CN | 101845943 | A | 9/2010 |
| CN | 204663496 | U | 9/2015 |
| CN | 107476785 | A | 12/2017 |
| CN | 108005585 | A | 5/2018 |
| CN | 208918864 | U | 5/2019 |
| CN | 110644972 | A | 1/2020 |
| CN | 214660057 | U | 11/2021 |
| CN | 114320860 | A | 4/2022 |
| CN | 216894843 | U | 7/2022 |

OTHER PUBLICATIONS

International Search Report and Written Opinion issued in corresponding PCT Application No. PCT/CN2022/118181, dated Dec. 5, 2022.

* cited by examiner

CAN SYSTEM AND DUAL ELECTRIC SUBMERSIBLE PUMP DEVICE

CROSS-REFERENCE TO RELATED APPLICATIONS

This application is a continuation application of International Application No. PCT/CN2022/118181, filed on Sep. 9, 2022, which claims priority to Chinese Patent Application No. 202111675401.3, filed on Dec. 31, 2021. The disclosures of the above-mentioned applications are incorporated herein by reference in their entireties.

TECHNICAL FIELD

The present application relates to the technical field of oil well development, and in particular to a can system and a dual electric submersible pump device.

BACKGROUND

In the oil extraction industry, dual electric submersible pump systems (one in use and one in standby) are widely used in situations where well workover costs are high, such as deepwater oil field development, unmanned platforms and so on. The electric pump needs to supply power from above ground to the well. Since the gap between the upper sealing system and the completion casing is very small, the challenge of the dual pump system during the descending process is that the power supply cable of the lower pump needs to pass outside the upper sealing system, the phenomenon of cables getting squeezed often occurs, thus causing well completion of the entire well to fail, delaying time and increasing the cost of repeated operations. In the related technology, the lower pump power supply cable is made into a flat shape, during the descending process, it is necessary to ensure that the flat surface is uniform and cannot be twisted, operation requirements are high operational requirements, the completion efficiency is low and the cable is easily damaged.

SUMMARY

The main purpose of the present application is to provide a can system and a dual electric submersible pump device, aiming to solve the technical problem that the pump cable is easily damaged when going down the well and thus resulting in low completion efficiency.

In order to achieve the above purpose, the present application proposes a can system, which is applied to a dual electric submersible pump device. The dual electric submersible pump device includes an upper pump assembly and a lower pump assembly. The can system includes:

- a can body provided with an accommodating cavity and a connecting hole in communication with the accommodating cavity, the upper pump assembly is located in the accommodating cavity, and a bottom end of the can body is connected to the lower pump assembly; and
- a connector assembly disposed passing through the connecting hole, one end of the connector assembly is electrically connected to a lower pump cable of the lower pump assembly, and another end of the connector assembly extends into the accommodating cavity and is electrically connected to a first power supply cable.

In an embodiment, the can body is provided with a first cavity and a second cavity communicated with each other the first cavity and the second cavity form the accommodating cavity, and the first cavity is located on a side of the can body away from the lower pump assembly, the second cavity is located on a side of the can body adjacent to the lower pump assembly, and the upper pump assembly is disposed inside the first cavity, a connection between the first cavity and the second cavity forms a step surface, and the connecting hole is disposed through the step surface.

In an embodiment, a diameter of the first cavity is larger than a diameter of the second cavity, and a diameter of the second cavity is larger than a diameter of the connecting hole.

In an embodiment, the can body includes:

- a diameter section opened in the first cavity;
- a variable diameter section located at one end of the diameter section facing the lower pump assembly and connected to the lower pump assembly, the variable diameter section being opened in the second cavity;
- where in a direction from the diameter section toward the lower pump assembly, an outer diameter of the variable diameter section gradually decreases and forms a variable diameter outer surface, and the connecting hole is configured to sequentially penetrate the step surface and the variable diameter outer surface.

In an embodiment, a reinforcing portion is provided at a connection between the diameter section and the variable diameter section, the reinforcing portion and an inner wall of the diameter section form the step surface, and the reinforcing portion and an inner wall of the variable diameter section are enclosed to form the second cavity; and

- the connecting hole is opened in the reinforcing portion, and an axial direction of the connecting hole is parallel to and provided apart from an axial direction of the second cavity.

In an embodiment, the diameter section, the reinforcing portion and the variable diameter section are provided as an integrated structure.

In an embodiment, the connector assembly includes:

- a penetrating member disposed passing through the connecting hole and sealingly connected to a hole wall of the connecting hole, an electric conductor is provided inside the penetrating member;
- an upper connector connected to one end of the penetrating member that extends into the accommodating cavity and provided apart from the upper pump assembly; and
- a lower connector connected to another end of the penetrating member located outside the accommodating cavity, and the upper connector is electrically connected to the lower connector through the electric conductor.

In an embodiment, an outer wall of the penetrating member is provided with a groove; and

- the connector assembly further includes a sealing member sleeved on the outer wall of the penetrating member and limited in the groove.

In an embodiment, a plurality of the sealing members are provided, and the plurality of the sealing members are provided at intervals.

In an embodiment, the hole wall of the connecting hole is provided with a limiting groove, an inner ring of the sealing member is limited in the groove of the penetrating member, and an outer ring of the sealing member is limited in the limiting groove.

In an embodiment, the upper pump assembly is provided with an upper pump cable, the can system further includes a sealing cover body located on a top of the can body, the sealing cover body is provided with at least one first through hole and at least one second through hole, the at least one first through hole is configured for the first power supply cable to pass through, the at least one second through hole is provided apart from the at least one first through hole, and the at least one second through hole is configured for the upper pump cable to pass through.

In an embodiment, the can system further includes a limiting member located in the accommodating cavity and detachably connected to the upper pump assembly, a limiting portion is provided on at least one side of the limiting member away from the upper pump assembly, and the limiting portion is configured to limit one end of the connector assembly extending into the accommodating cavity.

In an embodiment, the upper pump assembly is provided with an upper pump cable, the limiting member is further provided with a wire passing hole, and the wire passing hole is configured to limit the upper pump cable of the upper pump assembly.

The present application further proposes a dual electric submersible pump device, including:

- a pipe casing being hollow to form a downhole passage;
- the can system as described above, and the can system being located in the downhole passage;
- an upper pump assembly located in the accommodating cavity of the can system; and
- a lower pump assembly located in the downhole passage and detachably connected to a bottom end of the can system, the lower pump assembly is provided with the lower pump cable, and the lower pump cable is detachably connected to one end of the connector assembly of the can system.

In the technical solution of the present application, the connector assembly is arranged in the can system, and the technical problem of low well completion efficiency because of the lower pump cable being prone to damage during descent into the well is solved. A can system is applied to a dual electric submersible pump device, the dual electric submersible pump device includes an upper pump assembly and a lower pump assembly; the can system includes a can body and a connector assembly; the can body is provided with an accommodating cavity and a connecting hole in communication with the accommodating cavity; the connector assembly is disposed passing through the connecting hole; one end of the connector assembly is located in the accommodating cavity and used for being electrically connected with a first power supply cable, and the other end of the connector assembly is disposed outside the accommodating cavity and is electrically connected to a lower pump electrical cable. In a well completion process, the first power supply cable is electrically connected to the other end of the connector assembly in the can system, the lower pump cable introduces an electrical cable wire into the can system by means of the connector assembly; thus the shape requirements and the operation requirements of the lower pump cable are both reduced, while the probability that the lower pump cable is damaged due to small space is also reduced, and low well completion efficiency is increased.

BRIEF DESCRIPTION OF THE DRAWINGS

In order to explain the embodiments of the present application or the technical solutions in the existing technology more clearly, the accompanying drawings needed to be used in the description of the embodiments or the existing technology will be briefly introduced below. Obviously, the accompanying drawings in the following description are only some embodiments of the present application, other accompanying drawings can be obtained based on the provided accompanying drawings without exerting creative efforts for those of ordinary skill in the art.

DETAILED DESCRIPTION OF THE EMBODIMENTS

The technical solutions in the embodiments of the present application will be clearly and completely described below in conjunction with the accompanying drawings in the embodiments of the present application. Obviously, the described embodiments are only some of the embodiments of the present application, but not all of the embodiments. Based on the embodiments of the present application, all other embodiments obtained by those of ordinary skill in the art without any creative work fall within the protection scope of the present application.

It should be noted that in the embodiment of the present application, all directional indications are only used to explain the relative positional relationship, movement and so on between various components in a specific posture. If the specific posture changes, the directional indication will also change accordingly.

In the present application, unless otherwise clearly stated and limited, the terms "connection", "fixed" and so on should be understood in a broad sense. For example, "connection" can be a fixed connection, a detachable connection or an integral body; it can be a mechanical connection or an electrical connection; it can be a direct connection or an indirect connection through an intermediate medium; it can be an internal connection between two components, or the interaction between two components, unless otherwise expressly limited. For those of ordinary skill in the art, the specific meanings of the above terms in the present invention can be understood according to specific circumstances.

In addition, descriptions such as "first", "second" or the like in the present application are only for descriptive purposes and cannot be understood as indicating or implying the relative importance or implicitly indicating the quantity of the technical features indicated. Therefore, features defined as "first" and "second" may explicitly or implicitly include at least one of these features. In addition, the meaning of "and/or" appearing in the entire text includes three parallel solutions, taking "A and/or B" as an example, it includes solution A, or solution B, or a solution that satisfies both A and B at the same time. In addition, the technical solutions of various embodiments can be combined with each other, but it must be based on that those of ordinary skill in the art can realize. When the combination of technical solutions is contradictory or cannot be realized, it should be considered that such combination of technical solutions does not exist and is not within the protection scope claimed by the present application.

Referring to FIG. 1 to FIG. 6, the present application proposes a can system 100, which is applied to a dual electric submersible pump device 200.

It is defined that the upper pump assembly 60 is disposed above the lower pump assembly 80, and each embodiment will be described below based on this upper and lower position.

Figure 1:
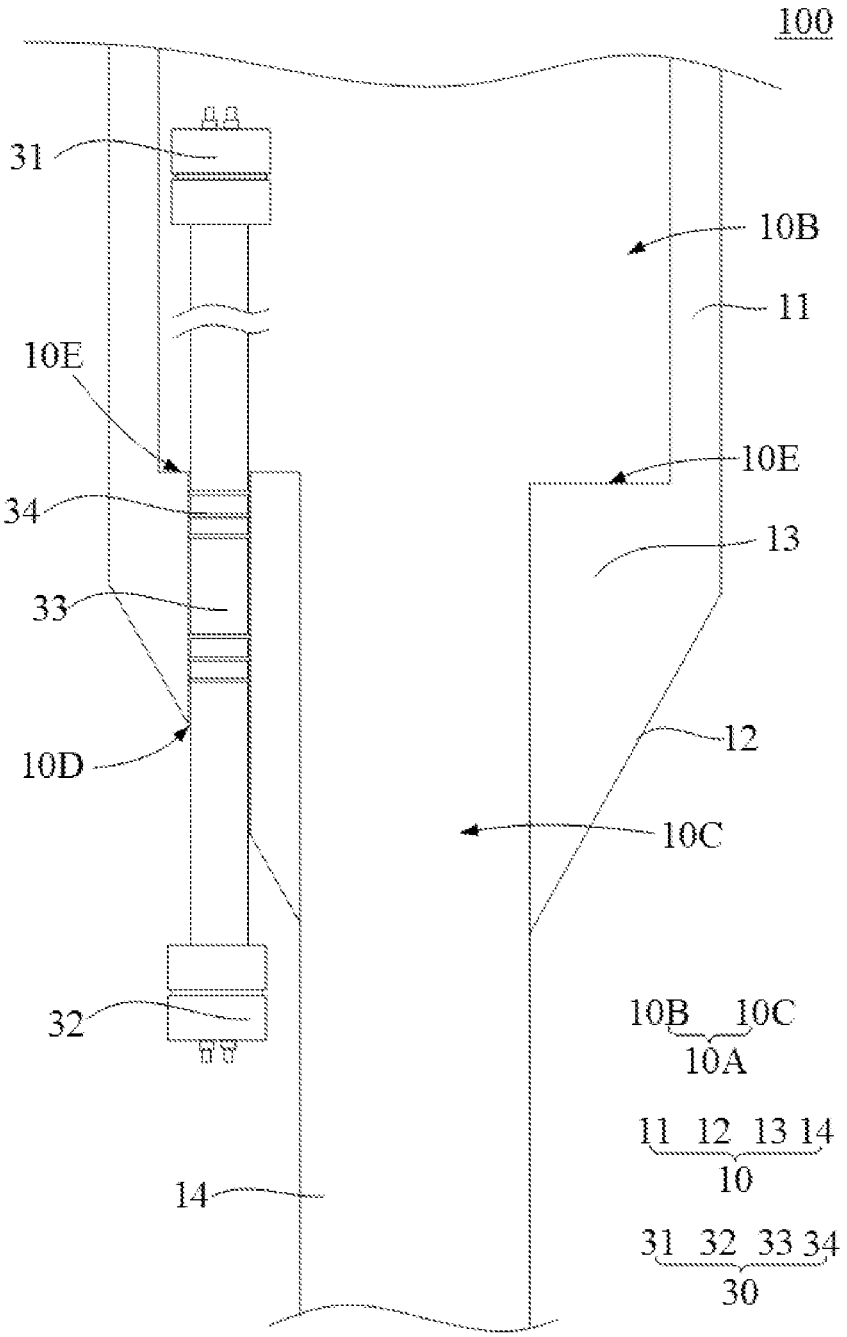
FIG. 1 is an internal structural schematic view of a can system according to an embodiment of the present application.
Figure 2:
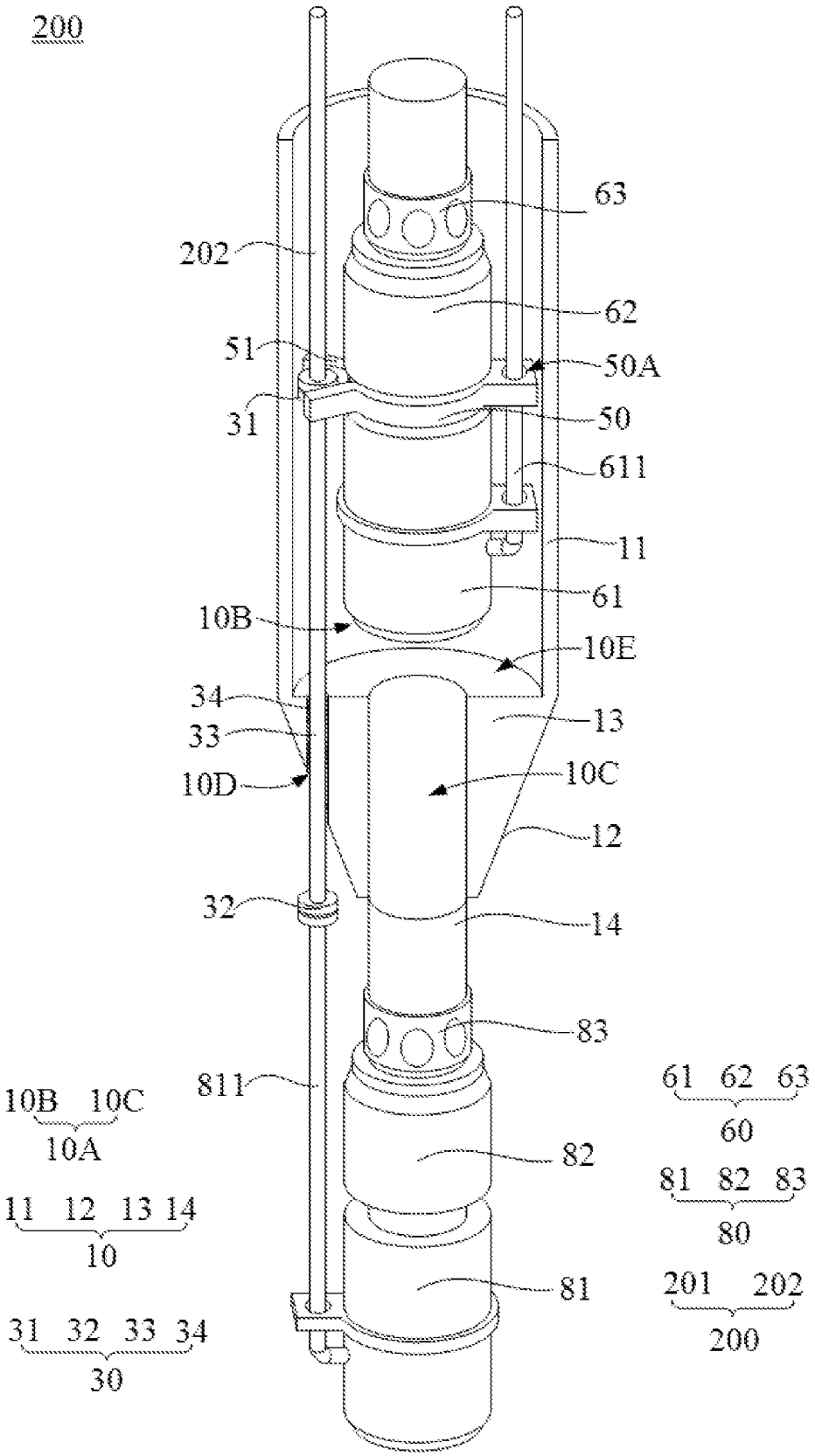
FIG. 2 is an internal three-dimensional structural schematic view of a dual electric submersible pump device according to an embodiment of the present application.
Figure 3:
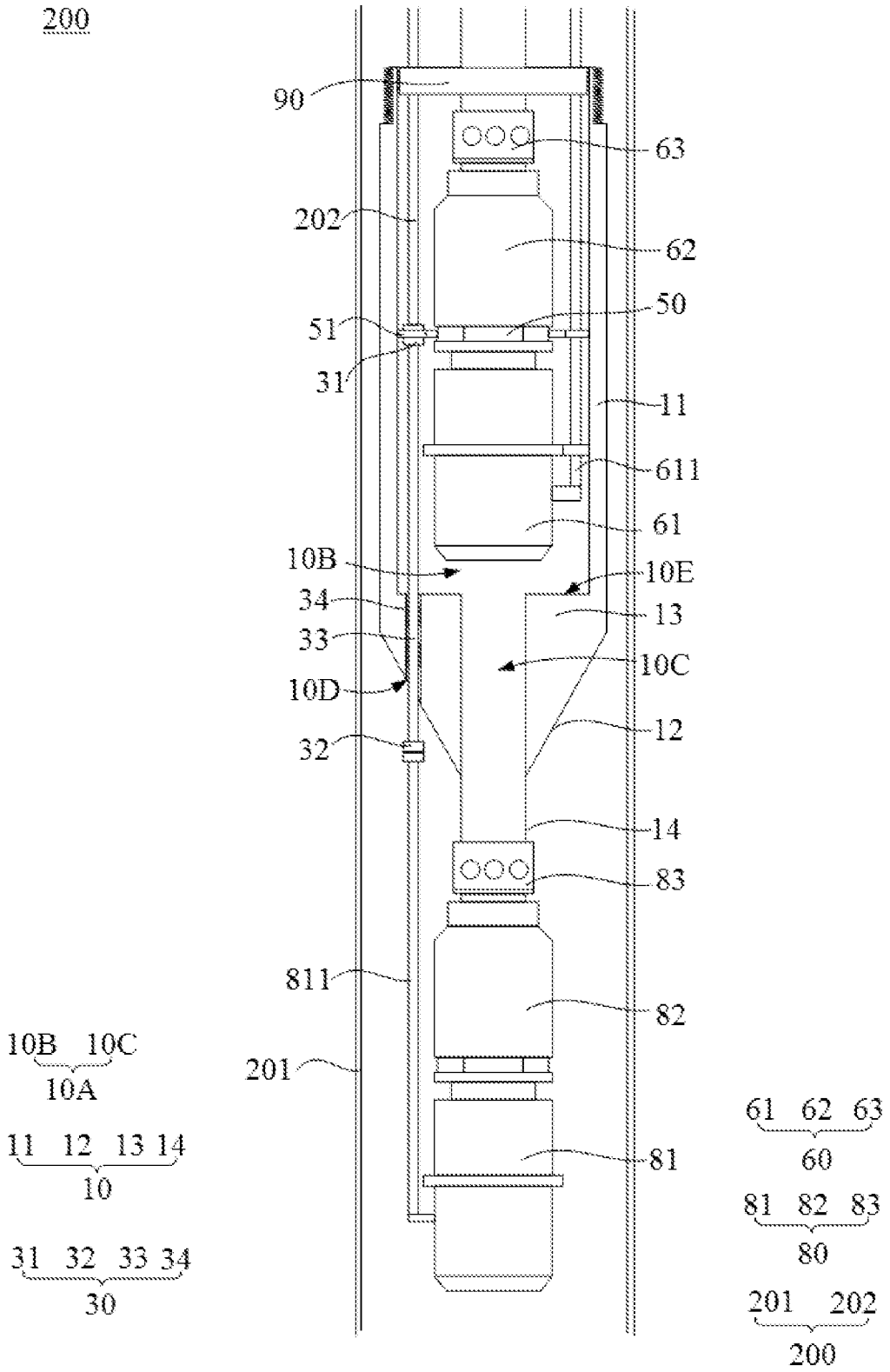
FIG. 3 is an internal structural schematic view of a dual electric submersible pump device according to an embodiment of the present application.

Specifically referring to FIG. 1 to FIG. 3, the dual electric submersible pump device 200 includes an upper pump assembly 60 and a lower pump assembly 80, the can system 100 includes a can body 10 and a connector assembly 30. The can body 10 is provided with an accommodating cavity 10A and a connecting hole 10D in communication with the accommodating cavity 10A, the upper pump assembly 60 is located in the accommodating cavity 10A, and a bottom end of the can body 10 is connected to the lower pump assembly 80. A connector assembly 30 is passed through the connecting hole 10D, one end of the connector assembly 30 is electrically connected to a lower pump cable 811 of the lower pump assembly 80, and the other end of the connector assembly 30 extends into the accommodating cavity 10A and is electrically connected to a first power supply cable 202.

In this embodiment, the can system 100 is applied to the dual electric submersible pump device 200, the dual electric submersible pump device 200 includes an upper pump assembly 60 and a lower pump assembly 80, the can system 100 includes a can body 10 and a connector assembly 30, the can body 10 is provided with an accommodating cavity 10A and a connecting hole 10D in communication with the accommodating cavity 10A, a connector assembly 30 is passed through the connecting hole 10D, one end of the connector assembly 30 is located in the accommodating cavity 10A and is provided apart from the upper pump assembly 60, one end of the connector assembly 30 is located in the accommodating cavity 10A for electrical connection with the first power supply cable 202, and one end of the connector assembly 30 away from the upper pump assembly 60 is located outside the accommodating cavity 10A and is electrically connected to the lower pump cable 811. During the well completion process, the first power supply cable 202 is electrically connected to the end of the connector assembly 30 that is deep into the accommodating cavity in the can system 100, the lower pump cable 811 introduces an electrical cable wire into the can system 100 by means of the connector assembly 30, the shape requirements and the operation requirements of the lower pump cable 811 are both reduced, while the probability that the lower pump cable is damaged due to small space is also reduced, and low well completion efficiency is increased.

It should be noted that a pipe casing 201 is provided on the wall of the oil well to form a downhole passage 20A, the can system 100 of the traditional well completion process includes multiple casing pipes of a certain length connected to each other. In order to protect the lower pump cable 811, a cable protection card will be installed on the can system 100, then there is a second challenge in the well completion process: since the gap between the inner wall of the downhole passage 20A of the oil well and the can system 100 is small, casings with couplings may not be used in the material selection of the can system 100, which reduces the strength of the connections of each casing of the can system 100, thereby limiting the hanging weight under the casings. The technical solution of the present application is to open a connecting hole 10D on the can system 100 and set the connector assembly 30 in the connecting hole 10D to solve the technical problem that the lower pump cable 811 is prone to damage during descent into the well and results in low completion efficiency, and allow the material selection of the can system 100 to use a casing with a coupling at the same time, thereby breaking through the hanging weight limit under the casing, and improving the connection strength of the can system 100.

In an embodiment, the can body 10 is provided with a first cavity 10B and a second cavity 10C communicated with each other the first cavity 10B and the second cavity 10C form the accommodating cavity 10A, and the first cavity 10B is located on a side of the can body 10 away from the lower pump assembly 80, the second cavity 10C is located on a side of the can body adjacent to the lower pump assembly 80, and the upper pump assembly 60 is disposed inside the first cavity 10B, a connection between the first cavity 10B and the second cavity 10C forms a step surface 10E, and the connecting hole 10D is disposed through the step surface 10E.

In this embodiment, the dual electric submersible pump device 200 includes a first power supply cable 202 and a second power supply cable, one end of the first power supply cable 202 is connected to the underground pump power supply device above the well, the other end extends into the downhole passage 20A and extends into the can system 100 and is electrically connected to one end of the connector assembly 30 in the can system 100 to power the lower pump assembly 80. One end of the second power supply cable is connected to the surface pump power supply device above the well, and the other end extends into the downhole passage 20A and is electrically connected to one end of the upper pump cable 611 to power the upper pump assembly 60. The can body 10 is provided with a first cavity 10B and a second cavity 10C that are arranged up and down and connected with each other to form an accommodating cavity 10A; the upper pump assembly 60 is disposed in the first cavity 10B, and one end of the connecting assembly extending into the accommodating cavity 10A is also located in the first cavity 10B for connecting the first power supply cable 202. The step surface 10E is formed at the connection between the first cavity 10B and the second cavity 10C, and the connecting hole 10D penetrates the cavity wall of the second cavity 10C and is disposed through the step surface 10E at the same time, the connector assembly 30 is passed through the connecting hole 10D and is configured to connect the first power supply cable 202 and the lower pump cable 811, thus making the routing of the lower pump cable 811 is located in the can system 100, ensuring that the entire casing string can be descended smoothly and the cable is not subject to potential extrusion damage, thereby reducing cable extrusion damage caused by space limitations and improving completion efficiency.

It can be understood that since the cables are routed through the can system 100, the space in the closed system in the upper can system 100 is occupied, the flow rate of well fluid flowing through the upper motor is increased objectively, which is beneficial to the heat dissipation of the motor.

In an embodiment, a diameter of the first cavity 10B is larger than a diameter of the second cavity 10C, and a diameter of the second cavity 10C is larger than a diameter of the connecting hole 10D.

In this embodiment, the first cavity 10B and the second cavity 10C are distributed in an up and down direction, an upper pump cable 611 is provided in the first cavity 10B, and the first cavity 10B needs to be connected to the first power supply cable 202 of the lower pump, so the diameter of the first cavity 10B is larger than the diameter of the second cavity 10C. The first cavity 10B is connected to the lower pump assembly 80, the diameter of the second cavity 10C is smaller than the diameter of the first cavity 10B, the structural outer diameter of the can system 100 forming the second cavity 10C is roughly similar to the outer diameter of the connection of the lower pump assembly 80, which facilitates connection and reduces weight and space occupation at the same time. The connecting hole 10D is opened on the can system 100, in order to ensure the strength of the can system 100, the hole diameter of the connecting hole 10D is much smaller than the diameters of the first cavity 10B and the second cavity 10C, and the hole diameter of the connecting hole 10D is sufficient for the connector assembly 30 to pass through, which improves the strength of the can system 100, changes the routing of the lower pump cable 811, and protects the lower pump cable 811 from extrusion and wear.

It will be appreciated that since the lower pump cable 811 is connected to the connector assembly 30 and the first power supply cable 202 above the well is connected within the can system 100, the shape of the lower pump cable 811 is no longer limited to flat, and round cables can be selected to improve selectivity.

In an embodiment, the can body 10 includes a diameter section 11 and a variable diameter section 12, the diameter section 11 is opened in the first cavity 10B; the variable diameter section 12 is located at one end of the diameter section 11 facing the lower pump assembly 80 and is connected to the lower pump assembly 80, the variable diameter section 12 is opened in the second cavity 10C; in a direction from the diameter section 11 toward the lower pump assembly 80, an outer diameter of the variable diameter section 12 gradually decreases and forms a variable diameter outer surface, and the connecting hole 10D is configured to sequentially penetrate the step surface 10E and the variable diameter outer surface.

In this embodiment, the can body 10 includes a diameter section 11 and a variable diameter section 12, the diameter section 11 and the variable diameter section 12 are distributed up and down, and the diameter section 11 and the variable diameter section 12 are integrally formed structural parts. The diameter section 11 is opened in the first cavity 10B, and the variable diameter section 12 is opened in the second cavity 10C, one end of the variable diameter section 12 away from the diameter section 11 is connected to the lower pump assembly 80, so that the second cavity 10C is connected to the lower pump assembly 80 to facilitate oil entering the second cavity 10C and the second cavity 10C when pumping oil. The outer diameter of the diameter section 11 is greater than or equal to the maximum outer diameter of the variable diameter section 12, the variable diameter section 12 is formed with a variable diameter outer surface, and the connecting holes 10D are respectively provided through the variable diameter outer surface and the step surface 10E, the outer diameter of the variable diameter section 12 gradually decreases from top to bottom, so that the connector assembly 30 is placed at a larger distance from the inner wall of the downhole passage 20A, thereby improving the protection of the lower pump cable 811 without affecting the connection between the lower pump assembly 80 and the lowermost end of the variable diameter portion. The provision of the variable diameter section 12 not only reduces the weight of the can body 10 but also increases the matching of the connection between the can body 10 and the lower pump assembly 80.

It can be understood that the lowermost end of the variable diameter section 12 is provided with a fixed diameter section 14 with a certain length, and the fixed diameter section 14 matches the outer diameter of the connection of the lower pump assembly 80.

In an embodiment, a reinforcing portion 13 is provided at a connection between the diameter section 11 and the variable diameter section 12, the reinforcing portion 13 and an inner wall of the diameter section 11 form the step surface 10E, and the reinforcing portion 13 and an inner wall of the variable diameter section 12 are enclosed to form the second cavity 10C; the connecting hole 10D is opened in the reinforcing portion 13, and an axial direction of the connecting hole 10D is parallel to and provided apart from an axial direction of the second cavity 10C.

In this embodiment, a reinforcing portion 13 is provided at a connection between the diameter section 11 and the variable diameter section 12, the reinforcing portion 13 is provided in the accommodating cavity 10A and forms the step surface 10E with the inner wall of the diameter section 11 and is enclosed with the inner wall of the variable diameter section 12 to form the cavity inner wall of the second cavity 10C, the setting of the reinforcing portion 13 enhances the stability of the connection between the variable diameter section 12 and the diameter section 11, a connecting hole 10D is opened in the reinforced part 13 at the same time, which greatly reduces the impact on the strength of the can body 10, thus breaking through the technical barrier that the existing can system 100 cannot directly drill holes in the side wall or bottom wall of the can system 100 for threading. The axial direction of the connecting hole 10D is parallel to and provided apart from the axial direction of the second cavity 10C, increasing the axial length of the connecting hole 10D as much as possible under the condition of ensuring the strength of the can body 10, so that when the connector assembly 30 is inserted into the connecting hole 10D, it can improve the connection reliability of the lower pump cable 811 and the first power supply cable 202, protect the lower pump cable 811, improve the smoothness of well descending, and correspondingly reduce the consumption of manpower and working hours and improve the well completion efficiency.

It can be understood that during the actual well completion process, the diameter section 11 will be formed by connecting multiple equal-diameter casings to each other, the variable diameter section 12 and the nearest diameter section 11 connecting the variable diameter section 12 are integrally formed structural parts, the reinforcing portion 13, the diameter section 11 and the variable diameter section 12 are also integrally formed structural parts. During casting and molding, the accommodating cavity 10A and the connecting hole 10D connecting the accommodating cavity 10A are opened to reduce the number of mold openings and facilitate the assembly of the can body 10.

In an embodiment, the connector assembly 30 includes a penetrating member 33, an upper connector 31 and a lower connector 32, the penetrating member 33 is disposed passing through the connecting hole 10D and is sealingly connected to a hole wall of the connecting hole 10D, an electric conductor is provided inside the penetrating member 33; the upper connector 31 is connected to one end of the penetrating member 33 that extends into the accommodating cavity 10A and is provided apart from the upper pump assembly 60; and the lower connector 32 is connected to another end of the penetrating member 33 located outside the accommodating cavity 10A, and the upper connector 31 and the lower connector 32 are electrically connected through the electric conductor.

In this embodiment, the connecting hole 10D is opened in the reinforced part 13 and is provided through the stepped surface 10E and the variable diameter surface of the variable diameter portion, the penetrating member 33 is disposed passing through the connecting hole 10D and is sealingly connected to a hole wall of the connecting hole 10D, thereby preventing oil from entering the first cavity 10B through the connecting hole 10D, thus improving the assembly stability of the connector assembly 30 and the can body 10, and effectively performing the connection bridge of the cable routing.

It can be understood that an outer wall of the penetrating member 33 is provided with a groove; and the connector assembly 30 further includes a sealing member 34 sleeved on the outer wall of the penetrating member 33 and limited in the groove. The sealing member 34 may be a deformable sealing ring or a water-swellable material, and the sealing member 34 has an interference fit with the hole wall of the connecting hole 10D.

It can be understood that the hole wall of the connecting hole 10D can be provided with a limiting groove accordingly, the sealing member 34 is respectively limited to the groove of the penetrating member 33 and the limiting groove of the hole wall of the connecting hole 10D, thereby reducing the gap between the penetrating member 33 and the hole wall of the connecting hole 10D and improving the installation stability and position limiting reliability of the penetrating member 33.

It can be understood that a plurality of the sealing members 34 can be provided, and the plurality of the sealing members 34 are provided at intervals. A plurality of grooves are correspondingly provided on the penetrating member 33, and a plurality of limiting grooves are correspondingly provided on the hole wall of the connecting hole 10D, thereby improving sealing reliability and enhancing the setting stability of the penetrating member 33.

Figure 5:
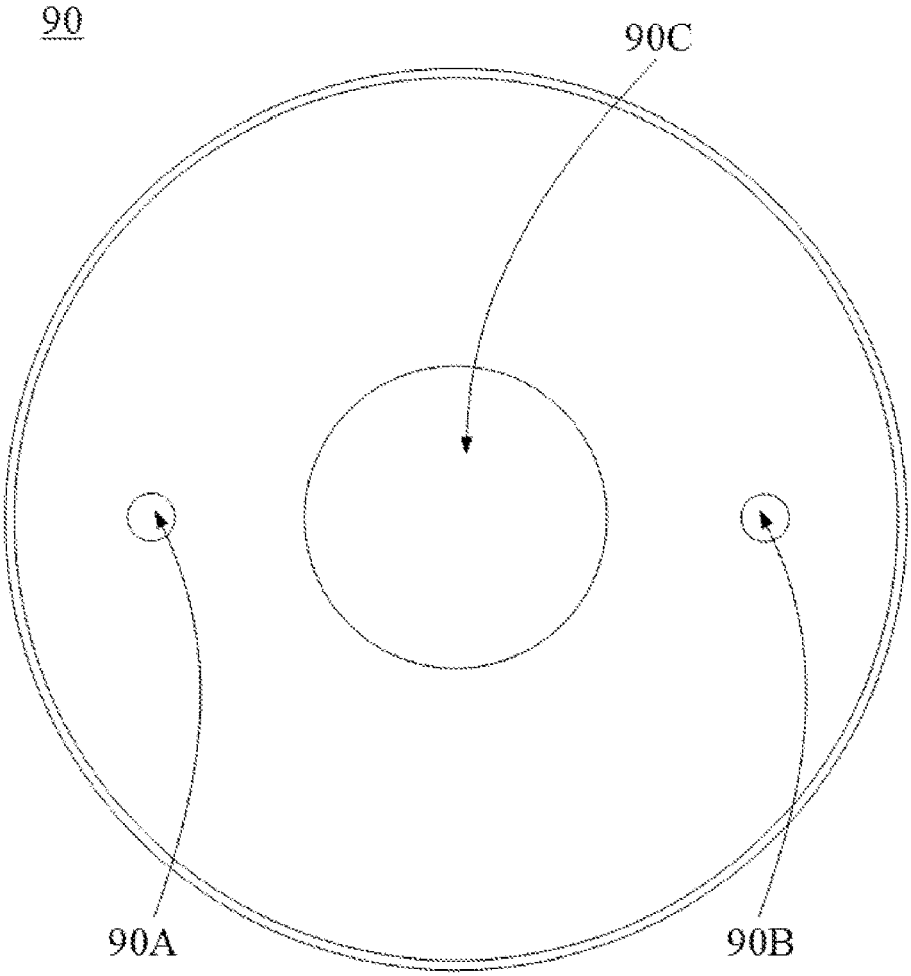
FIG. 5 is a structural schematic view of a sealing cover body of a dual electric submersible pump device according to an embodiment of the present application.
Figure 6:
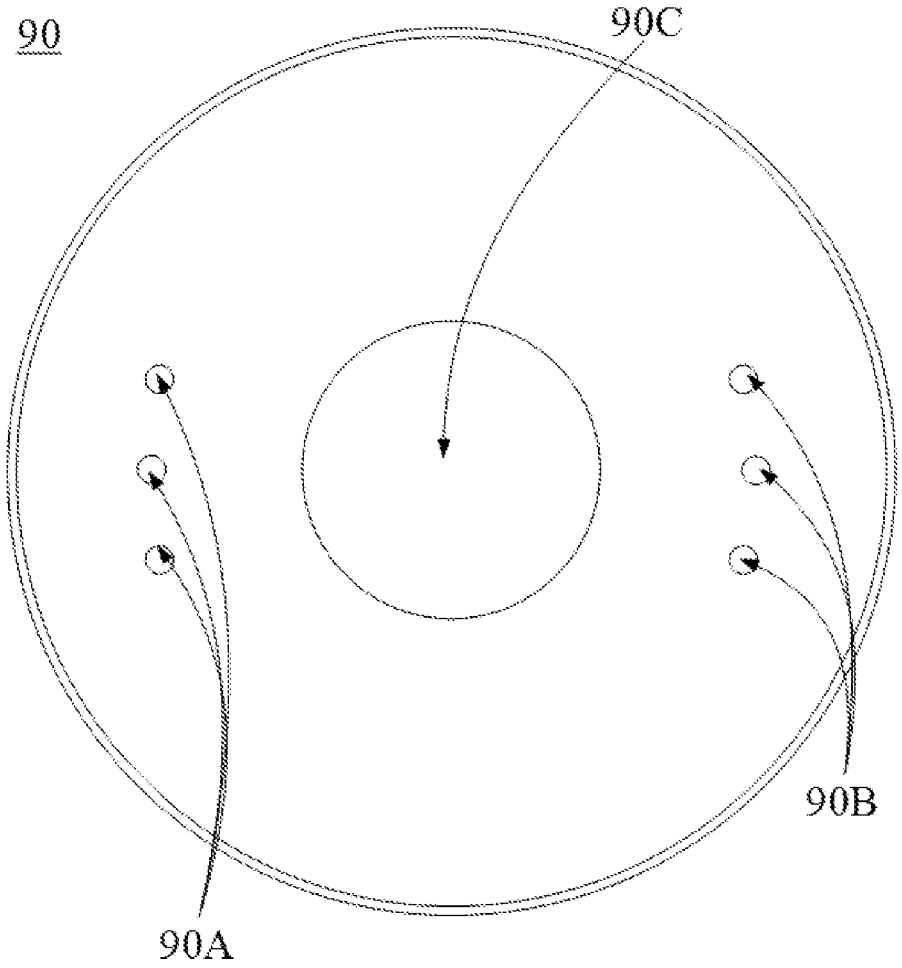
FIG. 6 is a structural schematic view of another sealing cover body of a dual electric submersible pump device according to an embodiment of the present application.

Referring to FIG. 5 and FIG. 6, in an embodiment, the upper pump assembly 60 is provided with an upper pump cable 611, the can system 100 further includes a sealing cover body 90 located on a top of the can body 10, the sealing cover body 90 is provided with at least one first through hole 90A and at least one second through hole 90B, the at least one first through hole 90A is configured for the first power supply cable 202 to pass through, the at least one second through hole 90B is provided apart from the at least one first through hole 90A, and the at least one second through hole 90B is configured for the upper pump cable 611 to pass through.

In this embodiment, the upper pump assembly 60 is provided with an upper pump cable 611, the can system 100 further includes a sealing cover body 90 for the can system 100. Since the strength of the sealing cover body 90 is related to the sealing performance, the first through hole 90A and the second through hole 90B are respectively provided on opposite sides of the sealing cover body 90 and are respectively configured for the first power supply cable 202 and the upper pump cable 611 to pass through, thereby improving the strength of the sealing cover body 90, and improving the connection stability between the upper pump cable 611 and the second power supply cable and the connection stability between the lower pump cable 811 and the first power supply cable 202.

It can be understood that three first through holes 90A and three second through holes 90B may be provided on the sealing cover body 90, the three first through holes 90A are configured for the three strands of the first power supply cable 202 to pass through and are performed sealing treatment, the three second perforations 90B are configured for the three strands of the upper pump cable to pass through and are performed sealing treatment, thereby reducing the diameter of the perforations, enhancing the strength of the sealing cover body 90 and improving the sealing performance of the can system 100.

It can be understood that a connector corresponding to the first power supply cable 202 and corresponding to upper pump cable can be provided on the sealing cover body 90, the first power supply cable 202 or the upper pump cable is detachably connected to the connector. The connector is sealingly passed through the sealing cover body 90, and two ends of the connector are correspondingly connected to the upper connector 31 and the first power supply cable 202 respectively, or the two ends of the connector corresponding to the upper pump cable 611 are correspondingly connected to the upper pump cable 611 and the second power supply cable, thereby facilitating the adjustment of the cable length.

It can be understood that a third through hole 90C that passes through the oil pumping pipe is opened in the middle of the sealing cover body 90, the first through hole 90A and the second through hole 90B are both provided around the third through hole 90C, and the first through hole 90A, the second through hole 90B and the third through hole 90C are spaced apart to maintain the structural strength of the sealing cover body 90.

Figure 4:
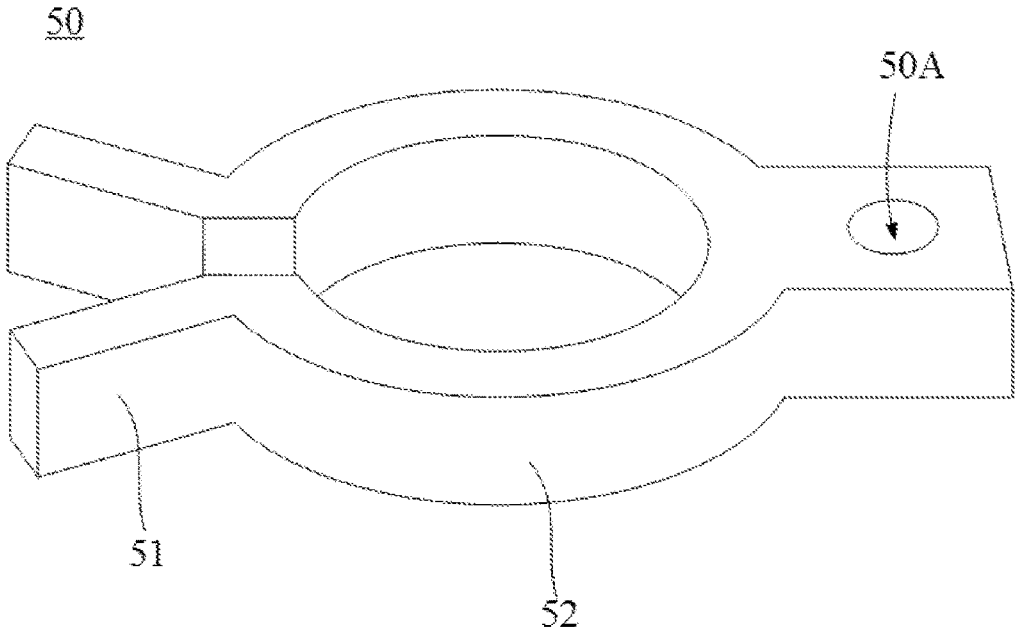
FIG. 4 is a structural schematic view of a limiting member of a dual electric submersible pump device according to an embodiment of the present application.

Referring to FIG. 4, in an embodiment, the can system 100 further includes a limiting member 50 located in the accommodating cavity 10A and detachably connected to the upper pump assembly 60, a limiting portion 51 is provided on at least one side of the limiting member 50 away from the upper pump assembly 60, and the upper connector 31 is limited in the limiting portion 51.

In this embodiment, the connector assembly 30 includes a penetrating member 33, an upper connector 31 and a lower connector 32, the upper connector 31 is provided at one end of the penetrating member 33 extending into the first cavity 10B, the can system 100 further includes a limiting member 50, the limiting member 50 is sleeved on the upper pump assembly 60 and is detachably connected to the upper pump assembly 60, the limiting member 50 includes a limiting portion 51 and a noumenon 52, the limiting portion 51 is provided on the side of the noumenon 52 facing the inner wall of the diameter section 11 and is configured to limit the upper connector 31, so that the upper connector 31 is limited in the accommodating cavity 10A and does not move randomly, thereby avoiding entanglement with the upper pump cable 611, improving safety and security, reducing the possibility of the upper connector 31 being washed away by oil due to movement and damaging the upper connector 31 at the same time, and reducing the number of repairs.

In an embodiment, the upper pump assembly 60 is provided with an upper pump cable 611, and the limiting member 50 is further provided with a wire passing hole 50A through it, and the wire passing hole 50A is configured to limit the upper pump cable 611 of the upper pump assembly 60.

In this embodiment, the upper pump assembly 60 is provided with an upper pump cable 611, the installation directions of the upper pump cable 611 and the lower pump cable 811 are provided to be staggered, thereby reducing the space occupancy rate of a certain side of the accommodating cavity 10A, and improving the uniformity of the space occupancy in the accommodating cavity 10A. The side of the noumenon 52 of the limiting member 50 away from the limiting portion 51 is further provided with a wire passing hole 50A through it, the wire passing hole 50A and the limiting portion 51 are also provided at intervals on the limiting member 50, or provided at intervals on opposite sides in some embodiment, thereby reducing the possibility of entanglement between the upper pump cable 611 and the upper connector 31 or entanglement between the upper pump cable 611 and the upper pump cable 611 and the first power supply cable 202, thus improving the reliability of wiring and the convenience of oil pumping.

It should be noted that there is also a third challenges in the well completion process at the same time: in order to protect the lower pump cable 811, a cable protection card is provided on the couplingless casing, due to space limitations and casing strength limitations, the cable protection card is easy to fall off, or the cable protection card may be damaged due to friction with the inner wall of the downhole passage 20A; there is also a fourth challenge at the same time, if cable protection cards are not provided, and some grooves are cut on the casing to fix the cables, the cutting grooves will affect the strength of the casing. The casing mentioned in the above two paragraphs is the diameter section 11 casing forming the can system 100, which is provided apart from the inner wall of the pipe casing 201 forming the downhole passage 20A, and belongs to structural members with different diameters. Applying the can system 100 according to the technical solution of the present application, the structure of providing a cable protection card outside the can body 10 of the can system 100 can be omitted, and there is no need to groove the outside of the can body 10 to maintain the strength of the can body 10. Applying the can body with the reinforcing portion 13 provided with the connecting hole 10D, and the connector assembly 30 is configured to introduce the wiring of the lower pump cable 811 into the can system to solve the above two challenges. Further, a limiting member 50 is provided inside the can system 100 to limit the upper pump cable 611 and the upper connector 31 respectively, thereby ensuring that the internal wiring of the can system is orderly and improving completion efficiency while maintaining the stability of oil pumping.

The present application further proposes a dual electric submersible pump device 200, which is applied in the technical field of oil well development. The dual electric submersible pump device 200 includes a pipe casing 201, a can system 100 as described above, an upper pump assembly 60 and a lower pump assembly 80, the specific structure of the can system 100 refers to the above-mentioned embodiments. Since the dual electric submersible pump device 200 according to the present application adopts all the technical solutions of all the above-mentioned embodiments, it has at least all the beneficial effects brought by the technical solutions of the above embodiments, which will not be described again one by one here. The pipe casing 201 is hollow to form a downhole passage 20A; the can system 100 is located in the downhole passage 20A; the upper pump assembly 60 is located in the accommodating cavity of the can system 100; and the lower pump assembly 80 is located in the downhole passage 20A and is provided with a lower pump cable 811; the lower pump cable 811 is detachably connected to one end of the connector assembly 30 of the can system 100 away from the upper pump assembly 60. By opening a connecting hole 10D on the can system 100 and disposing the connector assembly 30 in the connecting hole 10D, the technical problem of low well completion efficiency because of the lower pump cable being prone to damage during descent into the well is solved, and at the same time, the material selection of the can system 100 can use a casing with a coupling, breaking through the hanging weight limit under the casing, and improving the connection strength of the can system 100.

It can be understood that the upper pump assembly 60 includes an upper pump motor 61, an upper protector 62 and an upper reversing valve 63, the upper pump motor 61, the upper protector 62 and the upper reversing valve 63 are provided in sequence from the direction of the can system 100 toward the wellhead and communicate with each other. The limiting member can be sleeved between the upper pump motor 61 and the upper protector 62 to fix the upper connector 31, and the upper pump cable 611 is electrically connected to the upper pump motor 61. The lower pump assembly 80 includes a lower pump motor 81, a lower protector 82 and a lower reversing valve 83, the lower reversing valve 83, the lower protector 82 and the lower pump motor 81 are provided in sequence from the direction of the can system 100 away from the wellhead and communicate with each other. One end of the lower pump cable 811 is electrically connected to the lower pump motor 81, and the other end is electrically connected to the lower connector 32.

It can be understood that the lower pump assembly 80 may be equipped with a seal pot on its exterior, or may not be provided with a seal pot, which is not specifically limited in the present application.

The above are only some embodiments of the present application, and are not intended to limit the scope of the present application. Under the inventive concept of the present application, any equivalent structure transformation made by using the description and accompanying drawings of the present application, or directly or indirectly applied in other related technical fields, is included within the scope of the present application.

What is claimed is:

1. A can system, applied to a dual electric submersible pump device, wherein the dual electric submersible pump device comprises an upper pump assembly and a lower pump assembly, the can system comprises:

a can body provided with an accommodating cavity and a connecting hole in communication with the accommodating cavity, wherein the upper pump assembly is located in the accommodating cavity, and a bottom end of the can body is connected to the lower pump assembly; and a connector assembly passing through the connecting hole, wherein one end of the connector assembly is electrically connected to a lower pump cable of the lower pump assembly, and another end of the connector assembly extends into the accommodating cavity and is electrically connected to a first power supply cable;

wherein the can system further comprises a limiting member located in the accommodating cavity and detachably connected to the upper pump assembly, a limiting portion is provided on at least one side of the limiting member away from the upper pump assembly, and the limiting portion is configured to limit one end of the connector assembly extending into the accommodating cavity.

2. The can system according to claim 1, wherein the can body is provided with a first cavity and a second cavity communicated with each other, the first cavity and the second cavity form the accommodating cavity, the first cavity is located on a side of the can body away from the lower pump assembly, the second cavity is located on a side of the can body adjacent to the lower pump assembly, the upper pump assembly is disposed inside the first cavity, a connection between the first cavity and the second cavity forms a step surface, and the connecting hole is disposed through the step surface.

3. The can system according to claim 2, wherein a diameter of the first cavity is larger than a diameter of the second cavity, and a diameter of the second cavity is larger than a diameter of the connecting hole.

4. The can system according to claim 2, wherein the can body comprises:

a diameter section opened in the first cavity; and a variable diameter section located at one end of the diameter section facing the lower pump assembly and connected to the lower pump assembly, the variable diameter section being opened in the second cavity;

wherein in a direction from the diameter section toward the lower pump assembly, an outer diameter of the variable diameter section gradually decreases and forms a variable diameter outer surface, and the connecting hole is configured to sequentially penetrate the step surface and the variable diameter outer surface.

5. The can system according to claim 4, wherein:

a reinforcing portion is provided at a connection between the diameter section and the variable diameter section, the reinforcing portion and an inner wall of the diameter section form the step surface, and the reinforcing portion and an inner wall of the variable diameter section are enclosed to form the second cavity; and the connecting hole is opened in the reinforcing portion, and an axial direction of the connecting hole is parallel to and provided apart from an axial direction of the second cavity.

6. The can system according to claim 5, wherein the diameter section, the reinforcing portion and the variable diameter section are provided as an integrated structure.

7. The can system according to claim 1, wherein the connector assembly comprises:

a penetrating member passing through the connecting hole and sealingly connected to a hole wall of the connecting hole, wherein an electric conductor is provided inside the penetrating member;

an upper connector connected to one end of the penetrating member that extends into the accommodating cavity and provided apart from the upper pump assembly; and a lower connector connected to another end of the penetrating member located outside the accommodating cavity, wherein the upper connector is electrically connected to the lower connector through the electric conductor.

8. The can system according to claim 7, wherein:

an outer wall of the penetrating member is provided with a groove; and the connector assembly further comprises a sealing member sleeved on the outer wall of the penetrating member and limited in the groove.

9. The can system according to claim 8, wherein a plurality of the sealing members are provided, and the plurality of the sealing members are provided at intervals.

10. The can system according to claim 8, wherein the hole wall of the connecting hole is provided with a limiting groove, an inner ring of the sealing member is located in the groove of the penetrating member, and an outer ring of the sealing member is located in the limiting groove.

11. The can system according to claim 1, wherein the upper pump assembly is provided with an upper pump cable, the can system further comprises a sealing cover body located on a top of the can body, the sealing cover body is provided with at least one first through hole and at least one second through hole, the at least one first through hole is configured for the first power supply cable to pass through, the at least one second through hole is provided apart from the at least one first through hole, and the at least one second through hole is configured for the upper pump cable to pass through.

12. The can system according to claim 1, wherein the upper pump assembly is provided with an upper pump cable, the limiting member is further provided with a wire passing hole, and the wire passing hole is configured to limit the upper pump cable of the upper pump assembly.

13. A dual electric submersible pump device, comprising:

a pipe casing being hollow to form a downhole passage;

the can system according to claim 1, wherein the can system is located in the downhole passage;

the upper pump assembly located in the accommodating cavity of the can system; and the lower pump assembly located in the downhole passage and detachably connected to the bottom end of the can system, wherein the lower pump assembly is provided with the lower pump cable, and the lower pump cable is detachably connected to one end of the connector assembly of the can system.

* * * * *